US006588024B2

(12) United States Patent
Koelliker et al.

(10) Patent No.: US 6,588,024 B2
(45) Date of Patent: Jul. 8, 2003

(54) PORTABLE URINAL APPARATUS TO MINIMIZE SPILLAGE AND METHOD FOR USE

(76) Inventors: Randy Koelliker, 802E Spring St., Highland, KS (US) 66035; Douglas E. Lembke, 5614B Beechwood Blvd., St. Joseph, MO (US) 64503

( * ) Notice: Subject to any disclaimer, the term of this patent is extended or adjusted under 35 U.S.C. 154(b) by 0 days.

(21) Appl. No.: 10/201,398

(22) Filed: Jul. 23, 2002

(65) Prior Publication Data

US 2003/0014808 A1 Jan. 23, 2003

Related U.S. Application Data

(60) Provisional application No. 60/307,241, filed on Jul. 23, 2001.

(51) Int. Cl.[7] ..... A47K 11/00
(52) U.S. Cl. ..... 4/144.1; 4/144.3
(58) Field of Search ..... 4/144.1–144.4

(56) References Cited

U.S. PATENT DOCUMENTS

| | | | | | |
|---|---|---|---|---|---|
| 805,312 | A | | 11/1905 | Meinecke | 4/144.1 |
| 1,767,240 | A | | 6/1930 | Ivory et al. | 4/144.1 |
| 2,594,339 | A | | 4/1952 | Nugent | 4/144.1 |
| 3,716,871 | A | | 2/1973 | Borse | 4/110 |
| 4,270,231 | A | * | 6/1981 | Zint | 4/144.1 |
| 5,307,819 | A | | 5/1994 | Trautmann et al. | 128/767 |
| 5,406,651 | A | | 4/1995 | Nogay | 4/144.3 |
| 5,797,147 | A | | 8/1998 | Young et al. | 4/144.1 |
| 5,953,763 | A | * | 9/1999 | Gouget | 4/144.1 |
| 5,971,969 | A | | 10/1999 | Cashel | 604/323 |
| 6,021,529 | A | * | 2/2000 | Abbato | 4/144.1 |
| 6,119,280 | A | | 9/2000 | Rentsch | 4/144.1 |

* cited by examiner

*Primary Examiner*—Gregory Huson
*Assistant Examiner*—Amanda Flynn
(74) *Attorney, Agent, or Firm*—Weingarten, Schurgin, Gagnebin & Lebovici LLP

(57) ABSTRACT

A portable urinal has a baffle formed within a container to define a front collection chamber and a back collection chamber. The urinal is filled in a horizontal position, in which liquid is contained in the front collection chamber. The baffle's upper edge terminates a distance spaced from the top wall of the container to define a gap over which the liquid flows into the back collection chamber when the liquid exceeds the capacity of the front collection chamber or when the container is tipped upwardly. The baffle retains the contents in the back collection chamber if the urinal is rotated to hang on a bed rail or tipped back to a horizontal position for subsequent use. The urinal is emptied by turning it over to allow the liquid to flow past the baffle and out the opening.

19 Claims, 7 Drawing Sheets

PORTABLE URINAL APPARATUS TO MINIMIZE SPILLAGE AND METHOD FOR USE

CROSS REFERENCE TO RELATED APPLICATIONS

This application claims the benefit under 35 U.S.C. §119 (e) of U.S. Provisional Application No. 60/307,241, filed on Jul. 23, 2001, the disclosure of which is incorporated by reference herein.

STATEMENT REGARDING FEDERALLY SPONSORED RESEARCH OR DEVELOPMENT

N/A

BACKGROUND OF THE INVENTION

Portable urinals are devices, usually hand-held, that are used to collect urine during urination. For example, a portable urinal is necessary for a patient confined to bed or for the collection of a urine specimen for laboratory analysis. A portable urinal used by a patient in bed is susceptible to spillage after use. Such spillage is not desirable because it can create a health risk and must be cleaned up. Also, the patient may feel embarrassed and uncomfortable if the spill is in the patient's bed.

Most portable urinals are made in an economical manner by blow molding and have lids that are often inadequate to prevent leaks and spills. Because partially full urinals are often hung on bed rails after use, they must be rotated to fit over the bed rail. During such rotation, the potential for liquid to leak or spill is great if the lid is not properly seated or is defective. Furthermore, urinals are often used a second time without first being emptied. When the lid is removed and a partially filled urinal is placed for a second use, the potential exists for the contents to splash or spill out.

Some urinals have been designed with manual sealing devices or anti backflow features to overcome these problems. See U.S. Pat. Nos. 5,797,147, 5,953,763, and 6,021,529.

SUMMARY OF THE INVENTION

The present invention relates to a portable urinal that is simple to use and minimizes the risk of spillage during storage and subsequent uses. The urinal includes a container having an opening therein. A baffle is formed within an interior region in the container and defines a front collection chamber and a back collection chamber. The baffle extends from side to side across the interior region and upwardly from the bottom wall of the container at an acute angle toward the end wall of the container. Also, the baffle has an upper edge that terminates a distance spaced from the top wall of the container to define a gap between the top wall and the upper edge of the baffle.

In use in bed, the urinal is placed in a substantially horizontal position. Liquid collects in the front collection chamber, retained therein by the baffle. If the liquid exceeds the capacity of the front chamber, it flows over the top edge of the baffle into the back chamber, not out the opening. After use, the container is tipped toward an upright position, and the liquid flows over the top edge of the baffle into the back collection chamber for storage. Once in the back collection chamber, the liquid cannot readily flow into the front collection chamber, even with substantial tippage of the urinal. If the urinal is used a further time, the baffle retains the contents in the back collection chamber while the urinal is placed in the substantially horizontal position.

The container may be closed with a lid and may include a handle to hang on a bed rail. Spillage does not occur if the urinal must be rotated to fit over the bed rail. The urinal may also be stood on its end on a horizontal surface. The urinal is emptied by removing the lid and turning the container over with the handle down to allow the contents in the back chamber to flow past the baffle and out of the opening.

DESCRIPTION OF THE DRAWINGS

The invention will be more fully understood from the following detailed description taken in conjunction with the accompanying drawings in which.

DETAILED DESCRIPTION OF THE INVENTION

Figure 1:
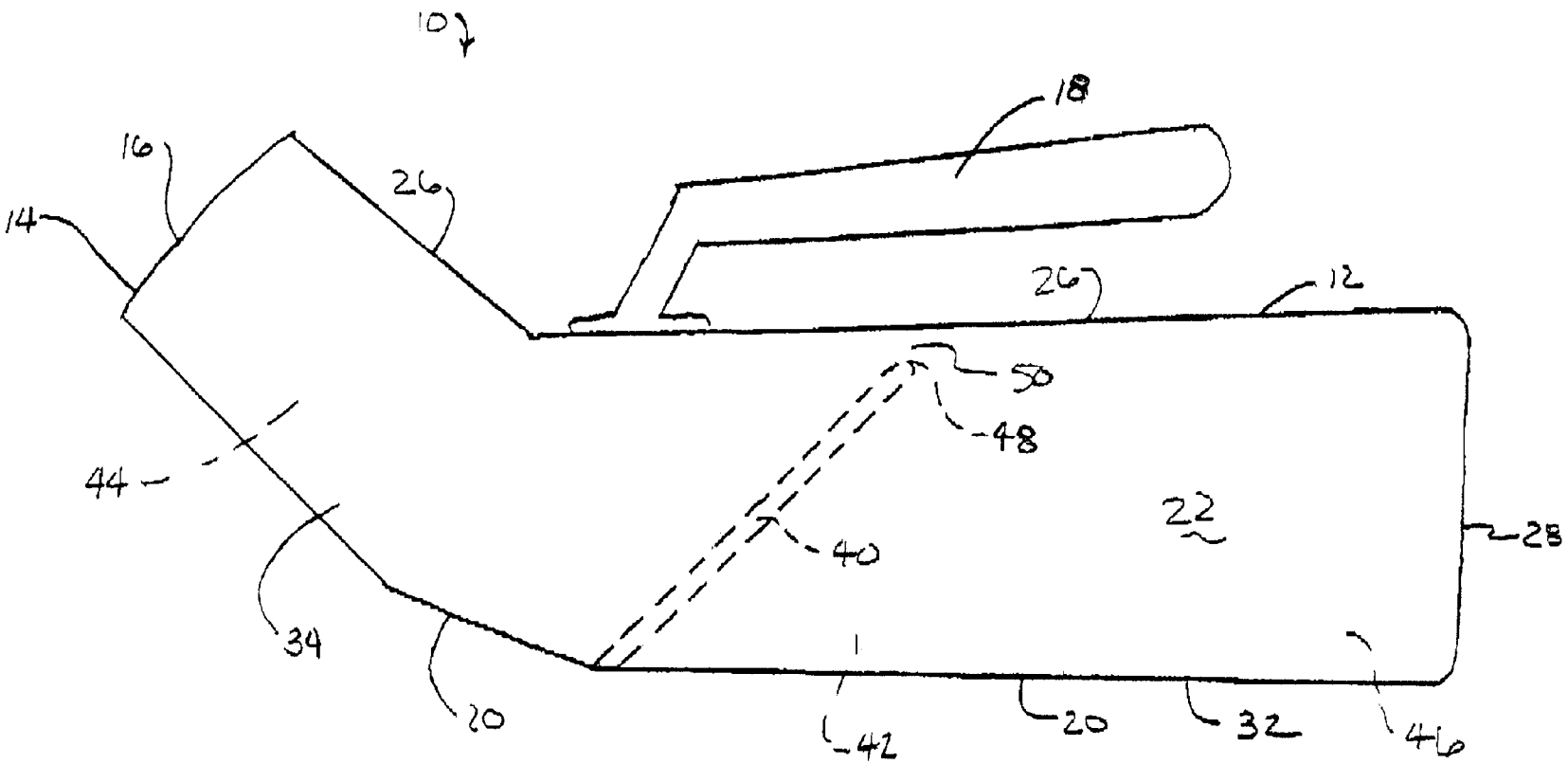
FIG. 1 is a side view of a portable urinal according to the invention.
Figure 2:
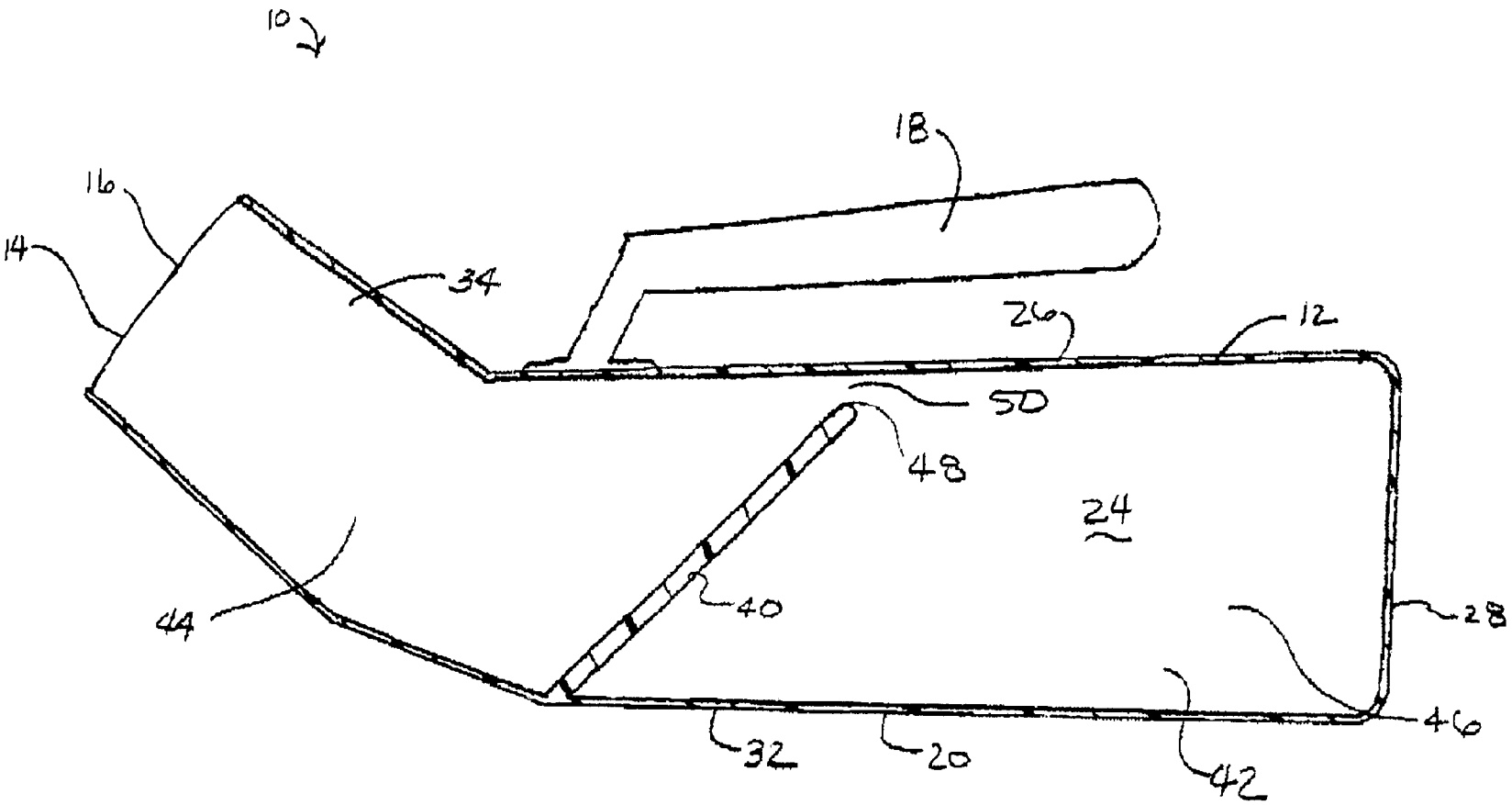
FIG. 2 is a cross-sectional side view of the urinal of FIG. 1.
Figure 3:
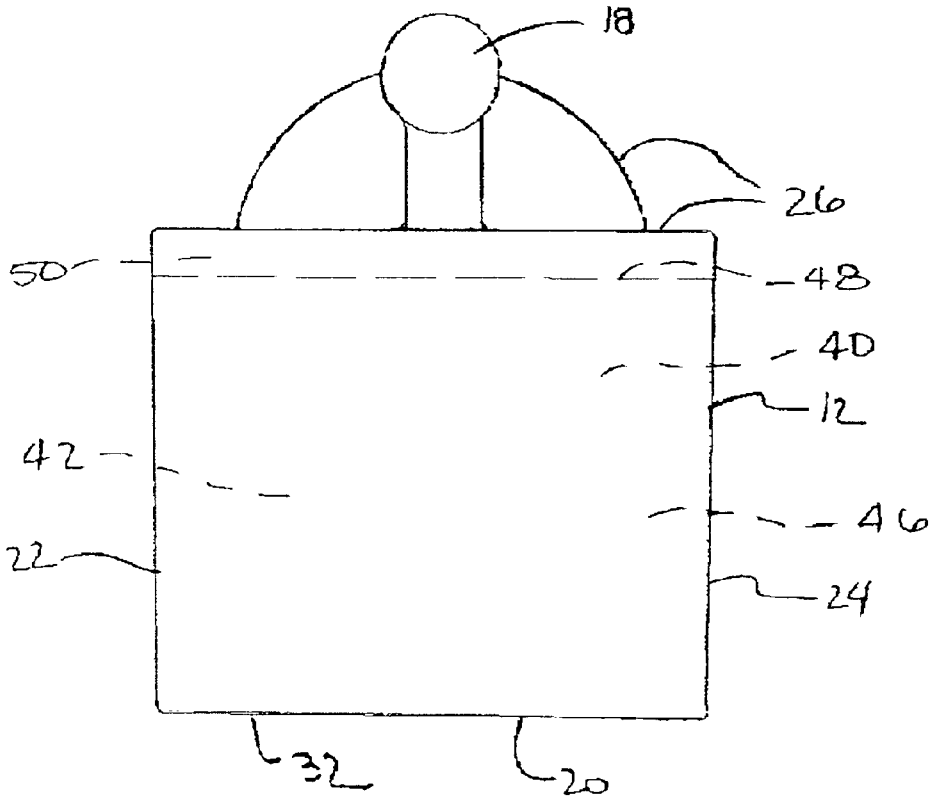
FIG. 3 is an end view of the urinal of FIG. 1.

A portable urinal 10 according to the present invention is illustrated in FIGS. 1–3. The urinal has a container 12 with an opening 14 at one end 16 and a handle 18. The container is elongated and, in the embodiment illustrated, has a generally square cross section with a bottom wall 20, two opposed side walls 22, 24, and a top wall 26, although any suitable cross section may be provided. The container is closed at an end wall 28. The handle 18 is attached to the top wall 26. At least a portion 32 of the bottom wall 20 is sufficiently flat so that the container may be laid down thereon to support the urinal on a surface. The closed end wall 28 may also be sufficiently flat to support the urinal on a surface.

Figure 9:
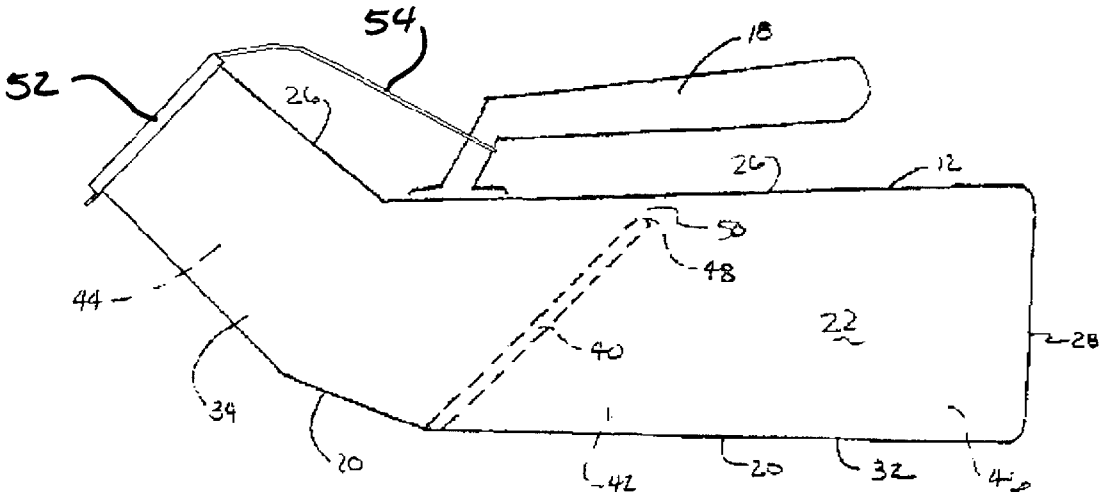
FIG. 9 is a side view of the urinal of FIG. 1 with a lid attached.
Figure 10:
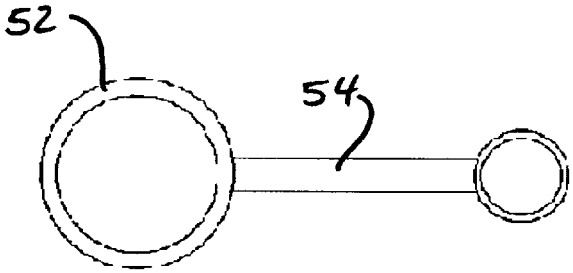
FIG. 10 is a top view of the lid of FIG. 9.

The container 12 also includes a neck portion 34 formed by extending the top wall, the bottom wall, and the side walls upwardly. In the embodiment shown, the neck portion has a circular cross section, although any suitable cross section may be provided. The opening 14 is formed at the end 16 of the neck portion 34 in a position elevated above the flat portion 32 of the bottom wall 20. A lid or cover 52 may be provided to close the opening 14 during storage. See FIGS. 9 and 10. The lid may be retained on the urinal, for example, by a strap 54 attached to the handle 18.

A baffle 40 is provided in the interior region 42 of the container 12. The baffle is placed at an acute angle within the container 12 and extends from the interior surface of one side wall 22 to the interior surface of the opposite side wall 24 along the interior of the bottom wall 20. The baffle divides the interior of the container into a first or front collection chamber 44 and a second or back collection chamber 46. The baffle terminates at an upper edge 48 spaced a small distance from the interior surface of the upper wall 26 to provide a fluid passage 50 between the front collection chamber 44 and the back collection chamber 46. Also, the upper edge 48 is lower than the lower lip of the opening 14 when the urinal is in a substantially horizontal position. In the embodiment illustrated, the baffle extends from the bottom wall 20 at a bend between the flat portion 32 of the bottom wall and the neck portion 34, although this location is not critical.

Figure 4:
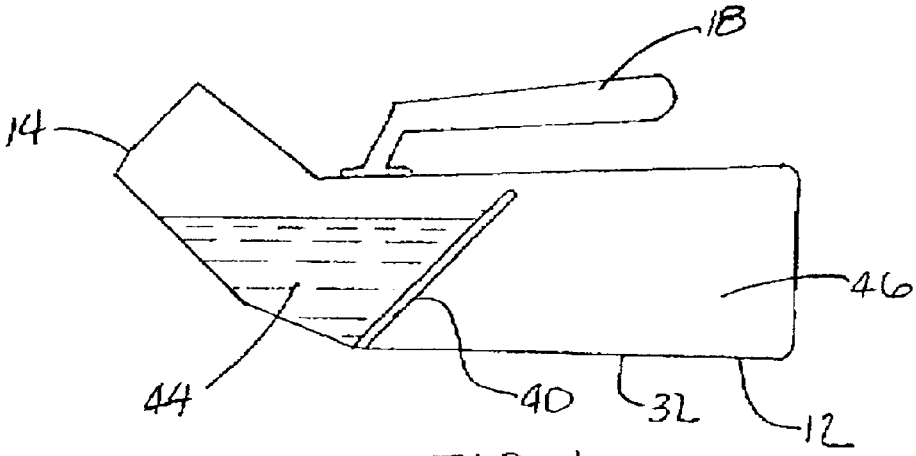
FIG. 4 is a side view of the urinal of FIG. 4 with the front collection chamber filled after use.
Figure 8:
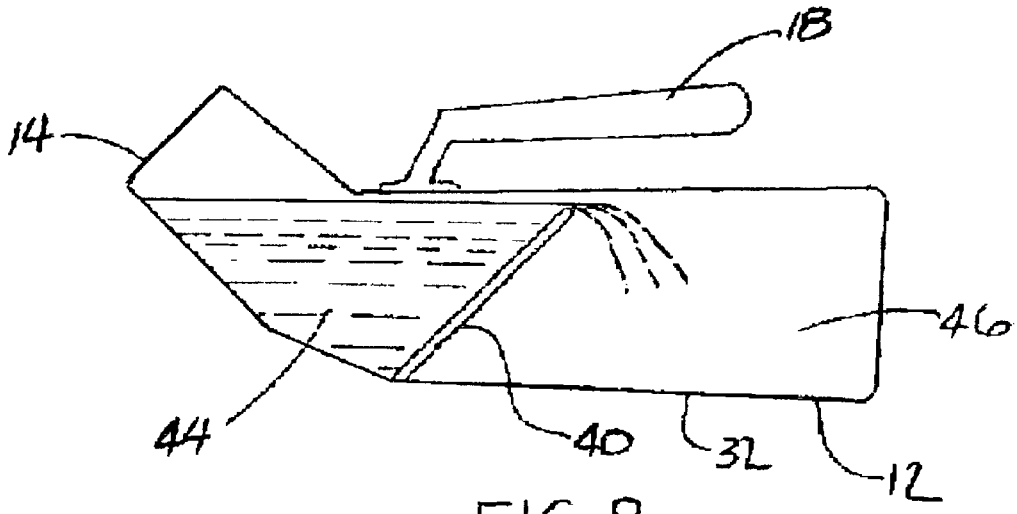
FIG. 8 is a side view of the urinal in which the contents exceeds the capacity of the front chamber and flows into the back chamber.

When used in bed, the urinal is placed in a substantially horizontal position. Liquid collects in the front collection chamber 44. See FIG. 4. Because the lower lip of the opening 14 is located above the upper edge 48 of the baffle 40 when the urinal is substantially horizontal, any liquid that exceeds the capacity of the front chamber flows over the baffle into the back chamber rather than spilling out of the opening. See FIG. 8.

Figure 5:
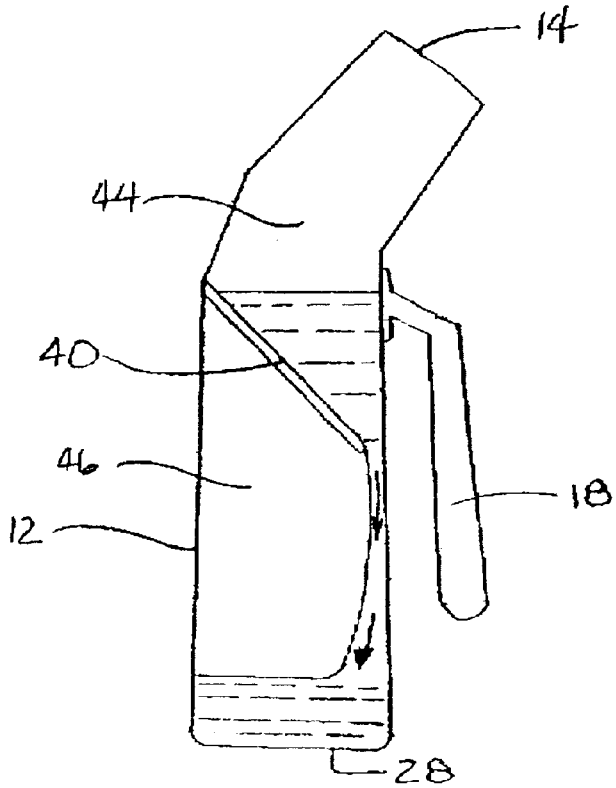
FIG. 5 is a side view of the urinal tipped to transfer the contents from the front chamber to the back chamber.
Figure 6:
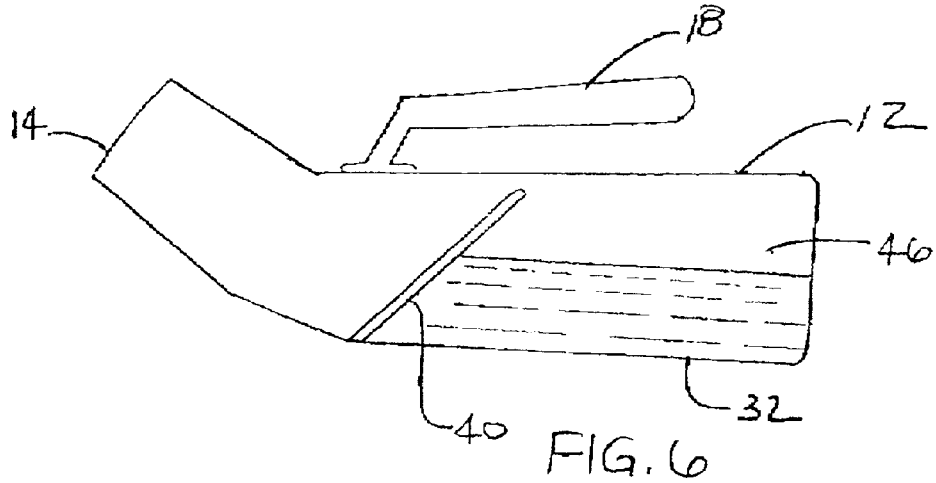
FIG. 6 is a side view of the urinal in a storage position with the contents in the back collection chamber.

After a use, the container 12 is tipped toward an upright position. See FIG. 5. In an upright position, the baffle 40 is angled downwardly to allow the contents to flow into the back collection chamber 46 for storage. Once the contents are in the back collection chamber 46, they cannot readily flow into the front collection chamber, even with substantial tippage of the urinal. See FIG. 6.

After use, the opening 14 may be closed with the lid, and the urinal may be hung by its handle 18 on a bed rail. If the urinal must be rotated to fit over a bed rail, the baffle 40 retains the contents in the back chamber 46, thereby preventing spillage or leakage. The urinal may also be placed on its end 28 on a table or other flat horizontal surface.

If the urinal is to be used a further time, the baffle 40 retains the contents in the back chamber 46 while the urinal is placed in a substantially horizontal position. See FIG. 6. In this manner, spilling or splashing of the contents is prevented during the further use.

Figure 7:
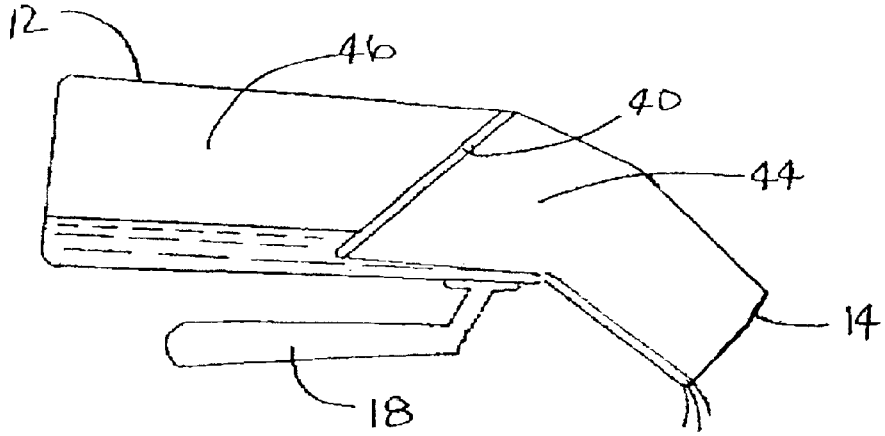
FIG. 7 is a side view of the urinal turned over to empty the contents.

To empty the urinal, the lid is removed, and the urinal is turned over, with the handle 18 down, as indicated in FIG. 7. In this manner, the contents in the back chamber 46 is able to flow past the baffle 40 and out of the opening 14 in the neck portion 34.

The container and the placement of the baffle may be arranged to accommodate any desired volume of liquid in the front chamber and the back chamber, such as one, two or more average uses. For example, the front chamber can be sized to hold 400 or 450 cc, and the back chamber can be sized to hold 500 or 600 cc of liquid.

The urinal is preferably made from a suitable plastic material such as polypropylene or polyethylene, although other materials, such as a ceramic, may also be used. The urinal may be made to be disposable after use by a single patient or to be reusable. If the urinal is to be reusable, the material should be capable of withstanding the high temperatures of sterilization equipment, typically 130° C.

The urinal may be made in any suitable manner. For example, the urinal may be made of a plastic material in a one-shot blow molding process, as would be known by one skilled in the art of mold design and blow molding. The urinal may also be made by injection molding in two halves that are then affixed together, such as with an adhesive.

The portable urinal of the present invention is economically manufacturable, is light weight, and is easy to clean. The urinal may readily be configured for female users as well as male users. The invention is not to be limited by what has been particularly shown and described, except as indicated by the appended claims.

What is claimed is:

1. A portable urinal comprising: a container having a top wall, a bottom wall, side walls, and an end wall defining an interior region and an opening Opposite the end wall;

a baffle formed within the interior region of the container and comprising an impervious element defining a front collection chamber between the opening and the baffle and a back collection chamber between the baffle and the end wall of the container;

the baffle extending from side to side across the interior region and upwardly from the bottom wall; and the baffle having an upper edge terminating a distance spaced from the top wall to define a gap between the top wall and the upper edge of the baffle;

whereby the baffle can block the entirety of fluid flow therethrough and maintain separation between liquid in the front collection chamber and liquid in the back collection chamber when the urinal is oriented in a substantially horizontal position for use, and liquid exceeding the capacity of the front collection chamber can flow over the upper edge of the baffle.

2. The urinal of claim 1, wherein the baffle extends at an acute angle from the bottom wall toward the top wall in a direction toward the end wall of the container.

3. The urinal of claim 1, wherein the opening has a lower lip disposed above the upper edge of the baffle when at least a portion of the bottom wall is substantially horizontal for use by a user.

4. The urinal of claim 1, wherein the opening is disposed above the upper edge of the baffle when the container is in the substantially horizontal position for use, whereby liquid exceeding the capacity of the front collection chamber flows over the upper edge of the baffle into the back collection chamber.

5. The urinal of claim 1, wherein the container includes an angled neck portion between the opening and the baffle.

6. The urinal of claim 1, wherein the bottom wall and the top wall are angled at a front portion of the container to define a neck portion, and the opening is in the neck portion.

7. The urinal of claim 1, wherein at least a portion of the bottom wall is flat for supporting the urinal on a surface.

8. The urinal of claim 1, wherein at least a portion of the end wall is flat for supporting the urinal on a surface.

9. The urinal of claim 1, wherein the opening is above a flat portion of the bottom wall when the container is resting on the flat portion of the bottom wall.

10. The urinal of claim 1, further comprising a handle disposed on an exterior of the top wall.

11. The urinal of claim 10, wherein the handle is configured as a hook to hook over a rail.

12. The urinal of claim 1, wherein the container and the baffle are formed of a plastic material.

13. The urinal of claim 1, wherein the container and the baffle are formed of a material capable of withstanding a sterilization temperature.

14. The urinal of claim 1, wherein the front collection chamber is sized to hold at least 400 cc of liquid.

15. The urinal of claim 1, wherein the back collection chamber is sized to hold at least 500 cc of liquid.

16. The urinal of claim 1, wherein the back collection chamber is sized to hold a greater volume of liquid than the front collection chamber.

17. A method of using the urinal of claim 1, comprising:

placing the container in a substantially horizontal position and filling the front collection chamber; and tipping the container upwardly to direct liquid flow into the back collection chamber.

18. The method of claim 17, further comprising storing the urinal in an upright position.

19. The method of claim 17, further comprising hanging the urinal on a bed rail.

* * * * *

UNITED STATES PATENT AND TRADEMARK OFFICE

CERTIFICATE OF CORRECTION

PATENT NO. : 6,588,024 B2 
APPLICATION NO. : 10/201398
DATED : July 8, 2003
INVENTOR(S) : Randy Koelliker et al.

It is certified that error appears in the above-identified patent and that said Letters Patent is hereby corrected as shown below:

The title page showing the illustrative figure should be deleted to be replaced with the attached title page.

The drawing sheets, 1-7 consisitng of Figs. 1-10, should be deleted to be replaced with drawing sheets, consisting of Figs. 1-10, as shown on the attached page.

Signed and Sealed this

Twentieth Day of February, 2007

JON W. DUDAS
*Director of the United States Patent and Trademark Office*

(12) United States Patent
Koelliker et al.

(10) Patent No.: US 6,588,024 B2
(45) Date of Patent: Jul. 8, 2003

(54) PORTABLE URINAL APPARATUS TO MINIMIZE SPILLAGE AND METHOD FOR USE

(76) Inventors: Randy Koelliker, 802E Spring St., Highland, KS (US) 66035; Douglas E. Lembke, 5614B Beechwood Blvd., St. Joseph, MO (US) 64503

( * ) Notice: Subject to any disclaimer, the term of this patent is extended or adjusted under 35 U.S.C. 154(b) by 0 days.

(21) Appl. No.: 10/201,398

(22) Filed: Jul. 23, 2002

(65) Prior Publication Data

US 2003/0014808 A1 Jan. 23, 2003

Related U.S. Application Data

(60) Provisional application No. 60/307,241, filed on Jul. 23, 2001.

(51) Int. Cl.[7] ..... A47K 11/00
(52) U.S. Cl. ..... 4/144.1; 4/144.3
(58) Field of Search ..... 4/144.1–144.4

(56) References Cited

U.S. PATENT DOCUMENTS

| | | | | |
|---|---|---|---|---|
| 805,312 A | | 11/1905 | Meinecke | 4/144.1 |
| 1,767,240 A | | 6/1930 | Ivory et al. | 4/144.1 |
| 2,594,359 A | | 4/1952 | Nugent | 4/144.1 |
| 3,716,871 A | | 2/1973 | Borse | 4/110 |
| 4,270,231 A | * | 6/1981 | Zint | 4/144.1 |
| 5,307,819 A | | 5/1994 | Trautmann et al. | 128/767 |
| 5,406,651 A | | 4/1995 | Nogay | 4/144.3 |
| 5,797,147 A | | 8/1998 | Young et al. | 4/144.1 |
| 5,953,763 A | * | 9/1999 | Gouget | 4/144.1 |
| 5,971,969 A | | 10/1999 | Cashel | 604/323 |
| 6,021,529 A | * | 2/2000 | Abbato | 4/144.1 |
| 6,119,280 A | | 9/2000 | Renisch | 4/144.1 |

* cited by examiner

*Primary Examiner*—Gregory Huson
*Assistant Examiner*—Amanda Flynn
(74) *Attorney, Agent, or Firm*—Weingarten, Schurgin, Gagnebin & Lebovici LLP

(57) ABSTRACT

A portable urinal has a baffle formed within a container to define a front collection chamber and a back collection chamber. The urinal is filled in a horizontal position, in which liquid is contained in the front collection chamber. The baffle's upper edge terminates a distance spaced from the top wall of the container to define a gap over which the liquid flows into the back collection chamber when the liquid exceeds the capacity of the front collection chamber or when the container is tipped upwardly. The baffle retains the contents in the back collection chamber if the urinal is rotated to hang on a bed rail or tipped back to a horizontal position for subsequent use. The urinal is emptied by turning it over to allow the liquid to flow past the baffle and out the opening.

19 Claims, 7 Drawing Sheets

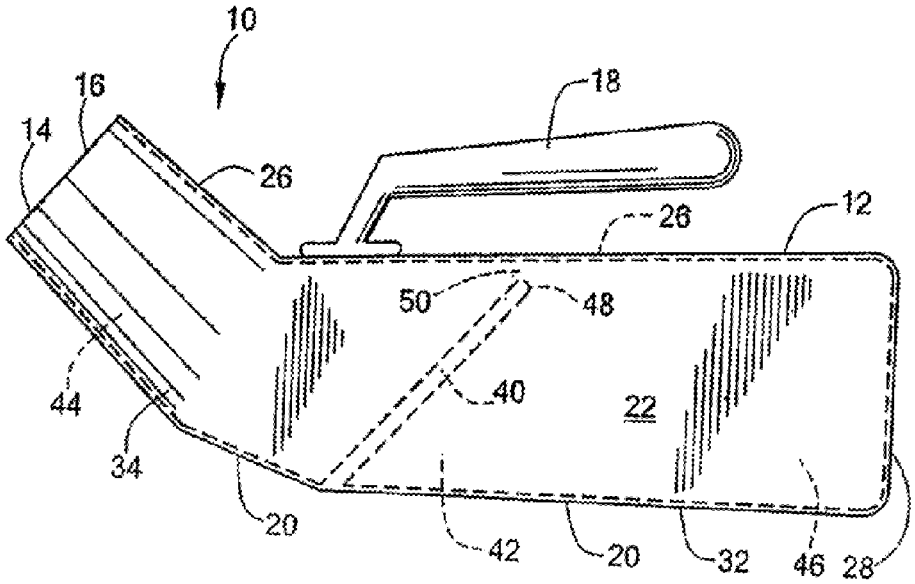

UNITED STATES PATENT AND TRADEMARK OFFICE

CERTIFICATE OF CORRECTION

PATENT NO. : 6,588,024 B2
APPLICATION NO. : 10/201398
DATED : July 8, 2003
INVENTOR(S) : Randy Koelliker et al.

It is certified that error appears in the above-identified patent and that said Letters Patent is hereby corrected as shown below:

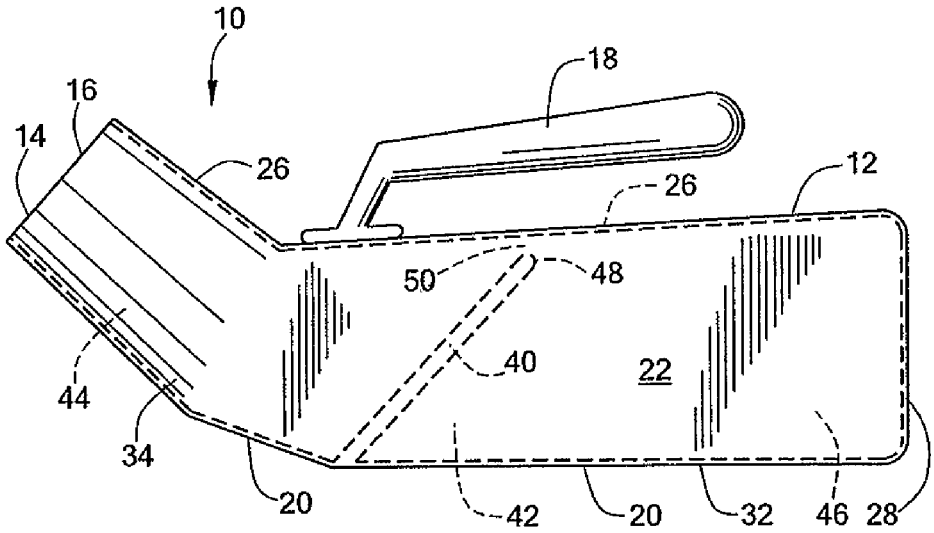

*FIG. 1*

UNITED STATES PATENT AND TRADEMARK OFFICE

CERTIFICATE OF CORRECTION

PATENT NO. : 6,588,024 B2
APPLICATION NO. : 10/201398
DATED : July 8, 2003
INVENTOR(S) : Randy Koelliker et al.

It is certified that error appears in the above-identified patent and that said Letters Patent is hereby corrected as shown below:

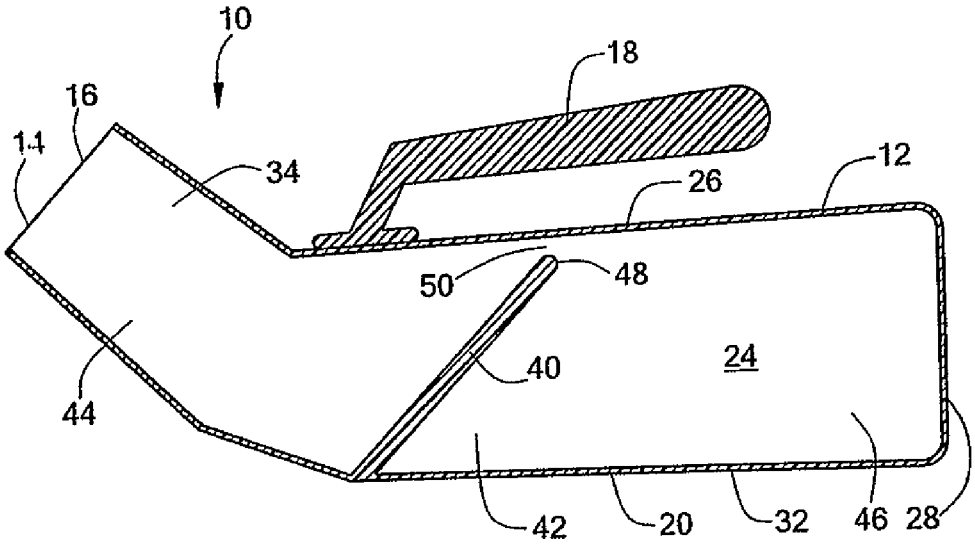

*FIG. 2*

UNITED STATES PATENT AND TRADEMARK OFFICE

CERTIFICATE OF CORRECTION

PATENT NO. : 6,588,024 B2 
APPLICATION NO. : 10/201398
DATED : July 8, 2003
INVENTOR(S) : Randy Koelliker et al.

It is certified that error appears in the above-identified patent and that said Letters Patent is hereby corrected as shown below:

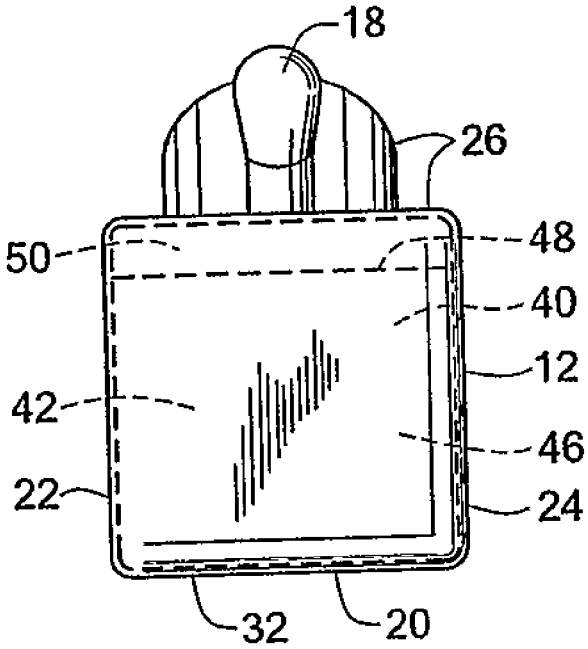

*FIG. 3*

UNITED STATES PATENT AND TRADEMARK OFFICE

CERTIFICATE OF CORRECTION

PATENT NO. : 6,588,024 B2
APPLICATION NO. : 10/201398
DATED : July 8, 2003
INVENTOR(S) : Randy Koelliker et al.

It is certified that error appears in the above-identified patent and that said Letters Patent is hereby corrected as shown below:

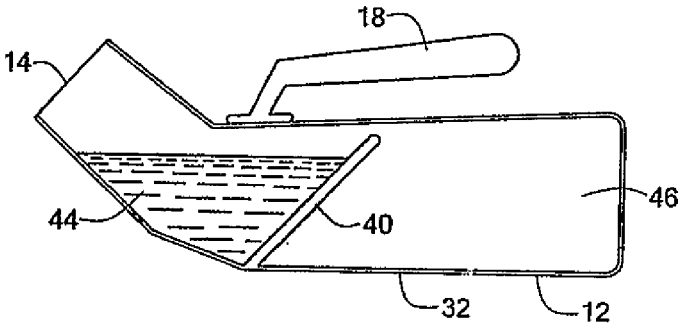

*FIG. 4*

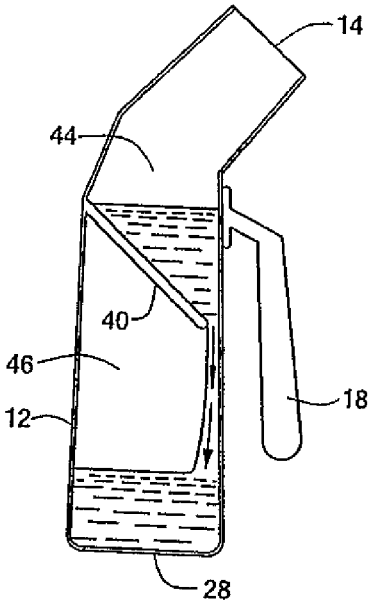

*FIG. 5*

UNITED STATES PATENT AND TRADEMARK OFFICE

CERTIFICATE OF CORRECTION

PATENT NO. : 6,588,024 B2
APPLICATION NO. : 10/201398
DATED : July 8, 2003
INVENTOR(S) : Randy Koelliker et al.

It is certified that error appears in the above-identified patent and that said Letters Patent is hereby corrected as shown below:

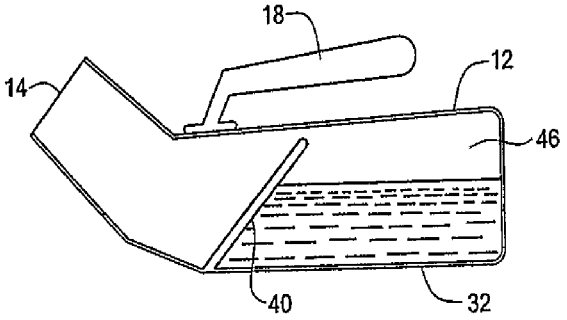

*FIG. 6*

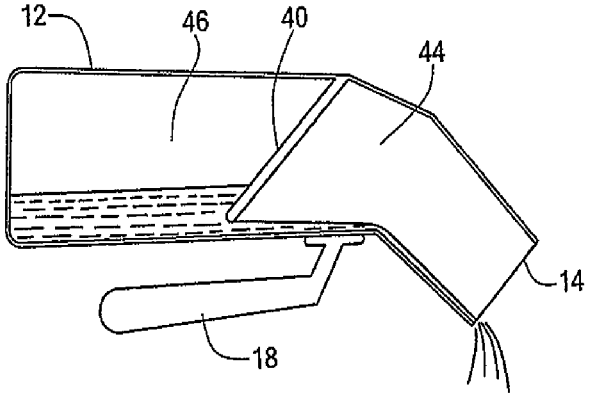

*FIG. 7*

UNITED STATES PATENT AND TRADEMARK OFFICE

CERTIFICATE OF CORRECTION

PATENT NO. : 6,588,024 B2 
APPLICATION NO. : 10/201398
DATED : July 8, 2003
INVENTOR(S) : Randy Koelliker et al.

It is certified that error appears in the above-identified patent and that said Letters Patent is hereby corrected as shown below:

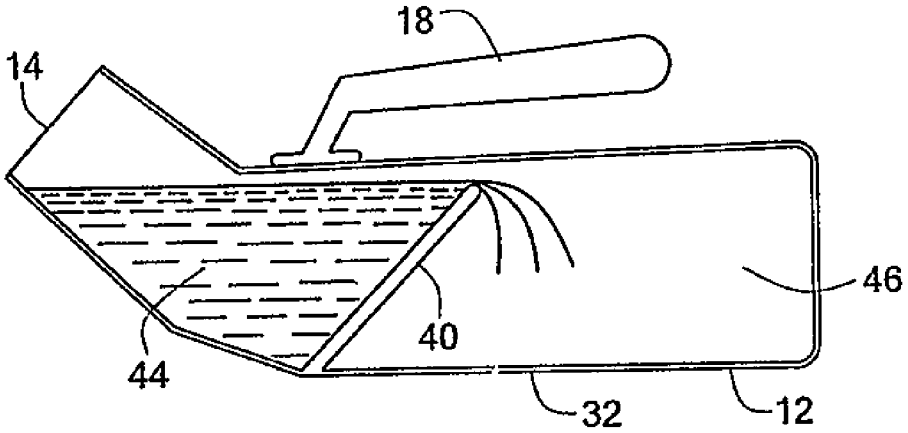

*FIG. 8*

UNITED STATES PATENT AND TRADEMARK OFFICE

CERTIFICATE OF CORRECTION

PATENT NO. : 6,588,024 B2 
APPLICATION NO. : 10/201398
DATED : July 8, 2003
INVENTOR(S) : Randy Koelliker et al.

It is certified that error appears in the above-identified patent and that said Letters Patent is hereby corrected as shown below:

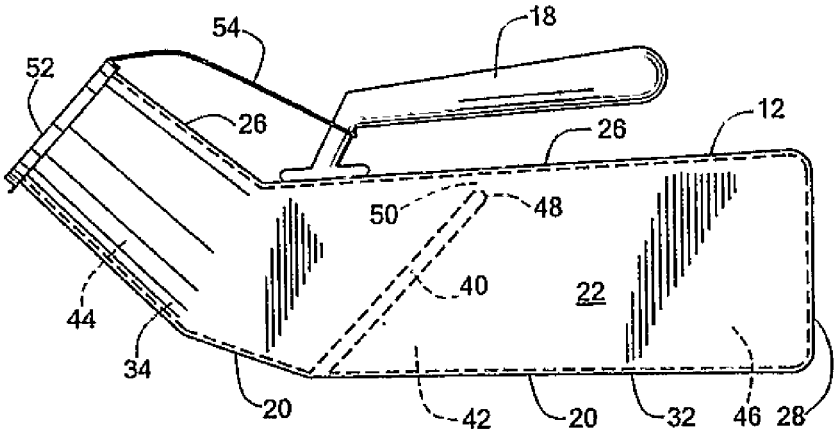

*FIG. 9*

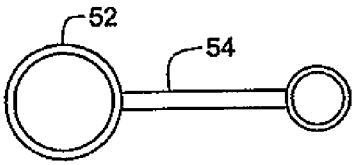

*FIG. 10*